US008057363B2

(12) United States Patent
Giannelli et al.

(10) Patent No.: US 8,057,363 B2
(45) Date of Patent: Nov. 15, 2011

(54) HOME ARC EXERCISE MACHINE

(75) Inventors: Raymond Giannelli, Franklin, MA (US); Scott Lee, Pomfret, CT (US)

(73) Assignee: Cybex International, Inc., Medway, MA (US)

( * ) Notice: Subject to any disclaimer, the term of this patent is extended or adjusted under 35 U.S.C. 154(b) by 509 days.

(21) Appl. No.: 12/053,254

(22) Filed: Mar. 21, 2008

(65) Prior Publication Data

US 2008/0261780 A1 Oct. 23, 2008

Related U.S. Application Data

(63) Continuation-in-part of application No. 29/276,249, filed on Jan. 19, 2007, now Pat. No. Des. 564,051, and a continuation-in-part of application No. 10/806,833, filed on Mar. 22, 2004, and a continuation-in-part of application No. 10/294,017, filed on Nov. 13, 2002, now abandoned.

(60) Provisional application No. 60/896,570, filed on Mar. 23, 2007, provisional application No. 61/019,691, filed on Jan. 8, 2008, provisional application No. 60/337,498, filed on Nov. 13, 2001.

(51) Int. Cl.
*A63B 22/04* (2006.01)

(52) U.S. Cl. ..... 482/52; 482/51

(58) Field of Classification Search ..... 482/51, 482/52, 53, 70, 71, 74, 79, 80, 148; 434/255; 601/23, 27, 33, 34, 35

See application file for complete search history.

(56) References Cited

U.S. PATENT DOCUMENTS

| | | | | |
|---|---|---|---|---|
| 326,247 | A | 9/1885 | Root | |
| 1,990,124 | A | 2/1935 | Kabisius | |
| 2,019,224 | A | 10/1935 | Hess | |
| 2,109,775 | A | 3/1938 | Hudson | |
| 3,756,595 | A | 9/1973 | Hague | |
| 3,791,646 | A | 2/1974 | Marchignoni | |
| 4,861,023 | A | 8/1989 | Wedman | |
| 5,039,088 | A * | 8/1991 | Shifferaw | 482/51 |
| 5,242,343 | A | 9/1993 | Miller | |
| 5,279,529 | A | 1/1994 | Eschenbach | |
| 5,383,829 | A | 1/1995 | Miller | |
| 5,391,130 | A | 2/1995 | Green | |
| 5,496,235 | A | 3/1996 | Stevens | |
| 5,562,574 | A | 10/1996 | Miller | |
| 5,584,781 | A | 12/1996 | Chen | |
| 5,605,521 | A | 2/1997 | Hsieh | |
| 5,611,756 | A * | 3/1997 | Miller | 482/52 |
| 5,643,153 | A | 7/1997 | Nylen et al. | |

(Continued)

FOREIGN PATENT DOCUMENTS

CA 2 407 758 11/2004

(Continued)

*Primary Examiner* — Loan Thanh
*Assistant Examiner* — Tam Nguyen
(74) *Attorney, Agent, or Firm* — Risman Hendricks & Oliverio, LLP

(57) ABSTRACT

An exercise device comprising:

a foot support arranged on a frame for supporting a user standing upright on the foot support, the foot support being movable on the frame back and forth between a rearward position and a forward position along an arcuate path;

the foot support being supported in a cantilevered arrangement on a rear linkage that is pivotally mounted on the frame for back and forth movement.

8 Claims, 7 Drawing Sheets

U.S. PATENT DOCUMENTS

| | | | |
|---|---|---|---|
| 5,655,998 | A | 8/1997 | Yu |
| 5,681,244 | A | 10/1997 | Hsieh |
| 5,685,804 | A | 11/1997 | Whan-Tong et al. |
| 5,707,320 | A | 1/1998 | Yu |
| 5,720,698 | A | 2/1998 | Dalebout et al. |
| 5,788,610 | A | 8/1998 | Eschenbach |
| 5,792,027 | A | 8/1998 | Gvoich |
| 5,833,584 | A | 11/1998 | Piaget et al. |
| 5,857,940 | A | 1/1999 | Husted |
| 5,876,307 | A | 3/1999 | Stearns et al. |
| 5,879,271 | A | 3/1999 | Stearns et al. |
| 5,895,339 | A | 4/1999 | Maresh |
| 5,910,072 | A | 6/1999 | Rawls et al. |
| 5,913,751 | A | 6/1999 | Eschenbach |
| 5,916,064 | A | 6/1999 | Eschenbach |
| 5,921,894 | A | 7/1999 | Eschenbach |
| 5,957,814 | A | 9/1999 | Eschenbach |
| 5,993,359 | A | 11/1999 | Eschenbach |
| 6,004,244 | A | 12/1999 | Simonson |
| 6,024,676 | A | 2/2000 | Eschenbach |
| 6,027,430 | A | 2/2000 | Stearns et al. |
| 6,036,622 | A | 3/2000 | Gordon |
| 6,042,512 | A | 3/2000 | Eschenbach |
| 6,045,488 | A | 4/2000 | Eschenbach |
| 6,053,847 | A | 4/2000 | Stearns et al. |
| 6,077,196 | A | 6/2000 | Eschenbach |
| 6,077,198 | A | 6/2000 | Eschenbach |
| 6,090,013 | A | 7/2000 | Eschenbach |
| 6,090,014 | A | 7/2000 | Eschenbach |
| 6,126,573 | A | 10/2000 | Eschenbach |
| 6,135,926 | A | 10/2000 | Lee |
| 6,142,915 | A | 11/2000 | Eschenbach |
| 6,168,552 | B1 | 1/2001 | Eschenbach |
| 6,210,305 | B1 | 4/2001 | Eschenbach |
| 6,217,485 | B1 | 4/2001 | Maresh |
| 6,248,044 | B1 | 6/2001 | Stearns et al. |
| 6,277,054 | B1 | 8/2001 | Kuo |
| D450,101 | S | 11/2001 | Hsu |
| 6,361,476 | B1 | 3/2002 | Eschenbach |
| 6,551,218 | B2 | 4/2003 | Goh |
| 6,648,801 | B2 | 11/2003 | Stearns et al. |
| 6,761,665 | B2 | 7/2004 | Nguyen |
| 2003/0092532 | A1 | 5/2003 | Giannelli et al. |

FOREIGN PATENT DOCUMENTS

| | | |
|---|---|---|
| DE | 229712 | 10/1923 |
| FR | 498.150 | 12/1919 |
| FR | 498150 | 12/1919 |
| WO | WO 96/08292 | 3/1996 |
| WO | WO 95/00209 | 1/1999 |

* cited by examiner

HOME ARC EXERCISE MACHINE

RELATED APPLICATIONS

This application claims the benefit of priority to U.S. Provisional Application Ser. No. 60/896,570 filed Mar. 23, 2007 and also to U.S. Provisional Application Ser. No. 61/019,691 filed Jan. 8, 2008 pursuant to 35 U.S.C. Secs. 119 and/or 120. This application is also a continuation in part of and claims the benefit of priority under 35 U.S.C. Sections 119 and 120 to U.S. patent application Ser. No. 10/294,017 filed Nov. 13, 2002 which claims priority to Provisional Application No. 60/337,498 filed Nov. 13, 2001. This application is also a continuation in part of and claims the benefit of priority under 35 U.S.C. Sections 119 and 120 to U.S. patent application Ser. No. 10/806,833 filed Mar. 22, 2004 and U.S. patent application Ser. No. 29/276,253 filed Jan. 19, 2007 and U.S. patent application Ser. No. 29/276,249 filed Jan. 19, 2007. The disclosures of all of the foregoing applications are incorporated by reference herein in their entirety as if fully set forth herein. Also incorporated herein by reference in its entirety as if fully set forth herein is Applicant's non-provisional application being concurrently filed this same date entitled Vertical Arc Exercise Machine.

Also incorporated herein by reference in their entireties as if fully set forth herein are the disclosures of published applications having publication numbers 2003/0092532 published May 15, 2003 (corresponding to Ser. No. 10/294,017) and 2004/0224825 published Nov. 11, 2004 (corresponding to Ser. No. 10/806,833).

FIELD OF THE INVENTION

The present invention relates to physical exercise machines and more particularly to an exercise apparatus that enables users to perform a simulated walking, running or other back and forth leg movement exercise.

BACKGROUND OF THE INVENTION

Exercise machines for simulating walking or running are known and used for directing the movement of a user's legs and feet in a variety of repetitive paths of travel. Machines commonly referred to as elliptical path machines have been designed to pivot the foot pedals on which the user's feet reside causing the pedals and the user's feet to travel in an elliptical or arcuate path. The foot supports are typically disposed between a pair of pivoting support arms that support the foot pedals and the user when standing on the foot pedals. The angular degree of pivoting of the foot pedals as the foot pedals travel from back to front and front to back along the path of travel or translation of the pedals typically varies by more than about 3 degrees and more typically more than about 10-30 degrees.

SUMMARY OF THE INVENTION

In accordance with the invention there is provided, an exercise device comprising:

a foot support arranged on a frame for supporting a user standing upright on the foot support, the foot support being movable on the frame back and forth between a rearward position and a forward position along an arcuate path; and the foot support being supported in a cantilevered arrangement on a rear linkage that is pivotally mounted on the frame for back and forth movement.

The rear linkage is preferably pivotally interconnected to a rotatable arm via a drive arm, the rear linkage driving the rotatable arm to rotate via the pivotal interconnection on back and forth movement of the foot support and rear linkage.

The rear linkage can form one of the linkages of a four bar linkage, the four bar linkage further comprising a bottom linkage and a front linkage that are pivotally interconnected to the rear linkage for back and forth movement, the foot support being mounted on or to the bottom linkage in the cantilevered arrangement rearward of the rear linkage.

The rotatable arm is preferably connected to a resistance mechanism. The rear linkage is typically pivotally interconnected to a link that is directly pivotally connected to the rotatable arm.

The exercise device preferably further comprises a manually graspable input arm pivotably interconnected to the foot support such that the arm pivots forwardly together with forward and upward movement of the foot support and rearwardly together with backward and downward movement of the foot support. The foot support is typically mounted for movement back and forth between a rearward down position and a forward up position.

The frame linkage is most preferably selectively adjustable to limit the back and forth travel of the frame linkage to any one of a plurality of separate reproducible segments of the overall arcuate path.

Further in accordance with the invention there is provided an exercise device comprising:

a frame supporting a frame linkage assembly;

left and right foot supports suspended on the frame linkage assembly for pivoting movement of the foot supports and the frame linkage assembly along a back and forth overall arcuate path; and the frame linkage assembly having a rear foot support linkage that is pivotally interconnected to a rotatable arm that is drivably rotated by the back and forth movement of the foot support and frame linkage assembly.

Most preferably, the foot supports are supported in a cantilevered arrangement on the frame linkage assembly rearward of the rear linkage.

The device typically further comprises a pair of left and right manually graspable input arms pivotably interconnected to a respective one of the left and right foot supports such that the left arm pivots forwardly together with forward movement of the left foot support and rearwardly together with backward movement of the left foot support and such that the right arm pivots forwardly together with forward movement of the right foot support and backwardly together with backward movement of the right foot support.

The foot supports are typically mounted for movement back and forth between a rearward down position and a forward up position. The frame linkage preferably comprises an arrangement of left and right front, bottom and rear linkages pivotally interconnected to each other, the foot supports being mounted on the bottom linkages rearward of the rear linkage.

The frame linkage is typically selectively adjustable to limit the back and forth travel of the frame linkage to any one of a plurality of separate reproducible segments of the overall arcuate path.

Further in accordance with the invention there is provided an exercise device comprising:

a frame supporting a frame linkage assembly;

left and right foot supports suspended on the frame linkage assembly for pivoting movement of the foot supports and the frame linkage assembly along a back and forth arcuate path; and the frame linkage assembly comprising left and right rear, bottom and front linkages, the rear linkages being pivotally interconnected by a direct linkage to an arm that is drivably rotatable by the back forth movement of the foot supports along the arcuate path.

In another aspect of the invention there is provided, a method of performing a back and forth foot motion exercise comprising:

standing on a pair of left and right foot supports of an exercise machine in a generally upright position, the foot supports being suspended on a frame of the exercise machine by a frame linkage assembly for movement back and forth along an arcuate path;

pivotally connecting a rear linkage of the frame linkage assembly directly to a rotatable arm such that the second rotatable arm is rotated as the frame linkage assembly is moved back and forth along the arcuate path;

disposing the foot supports in a cantilevered relationship on the frame linkage assembly; and forcibly driving the foot supports back and forth along the arcuate path with a user's feet together with the frame linkage assembly such that the rotatable arm is rotated.

Preferably the method further comprises connecting the rotatable arm to a resistance mechanism.

Most preferably the method further comprises selecting a segment of the arcuate path through which the foot supports are forcibly driven back and forth.

BRIEF DESCRIPTION OF THE DRAWINGS

The above and further advantages of the invention may be better understood by referring to the following description in conjunction with the accompanying drawings in which.

DETAILED DESCRIPTION

Generally, the present invention comprises an exercise apparatus that provides one or more foot supports arranged in a cantilevered fashion on linkages suspended on a frame, the foot supports being movable along an arcuate path and typically defined around a point of rotation. The arcuate path is divisible into a plurality of discrete, reproducible from front to back and back to front, machine defined, user selectable arc segments. The exercise apparatus includes a frame, a frame linkage movably engaged with the frame, one or more foot supports movably engaged with the frame linkage, a drive linkage connected between a rear linkage and a crank arm that is connected to a resistance mechanism, the crank arm being typically rotatable 360 degrees and connected to the resistance mechanism for resistance against the rotation. The apparatus preferably includes a tilt mechanism operative to move or tilt the location of the resistance mechanism and the 360 degree rotative crank arm with respect to the linkage assembly and foot supports.

Figure 1:
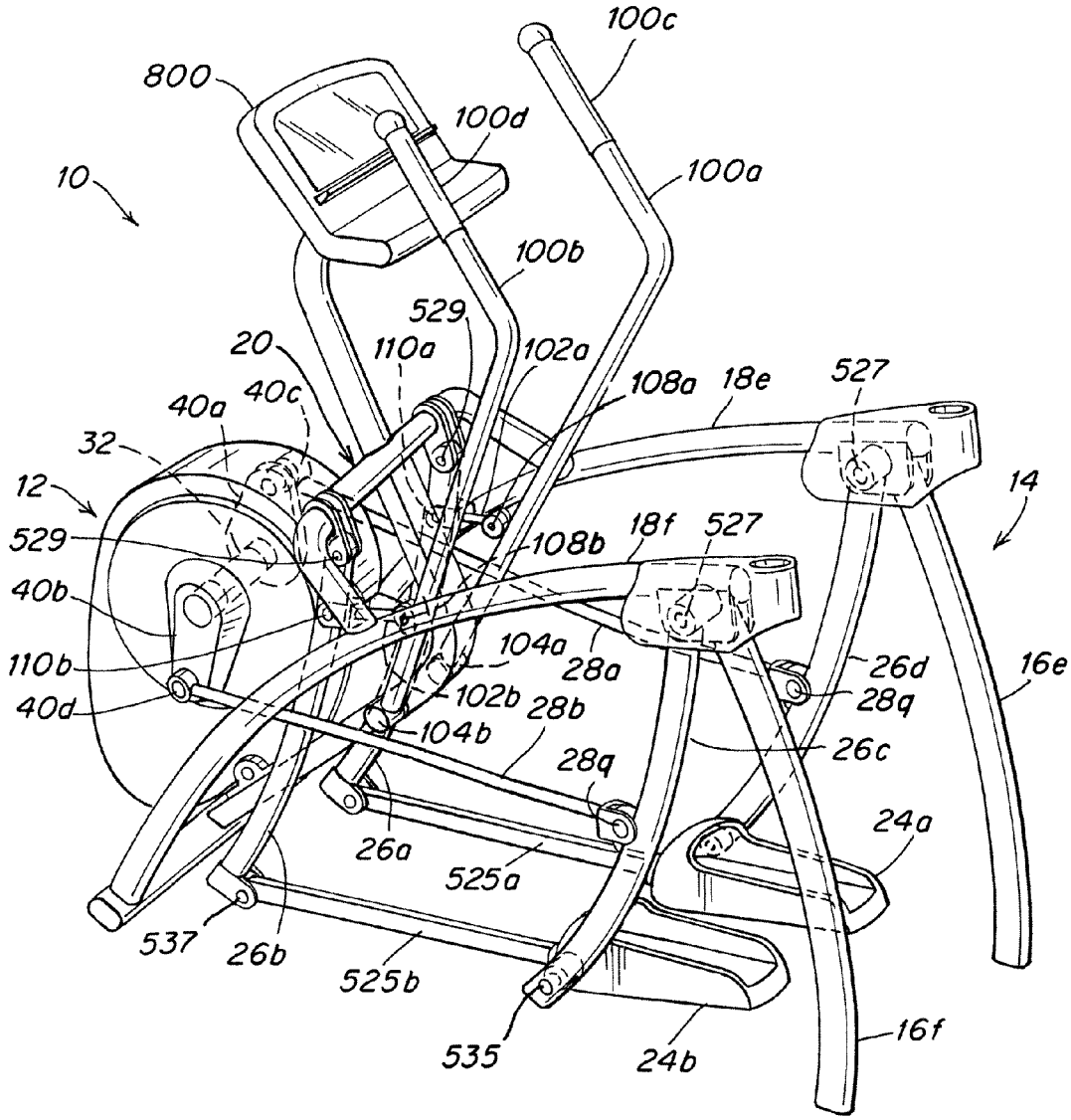
FIG. 1 is a rear perspective left side perspective view of an exercise machine in accordance with the invention.
Figure 2:
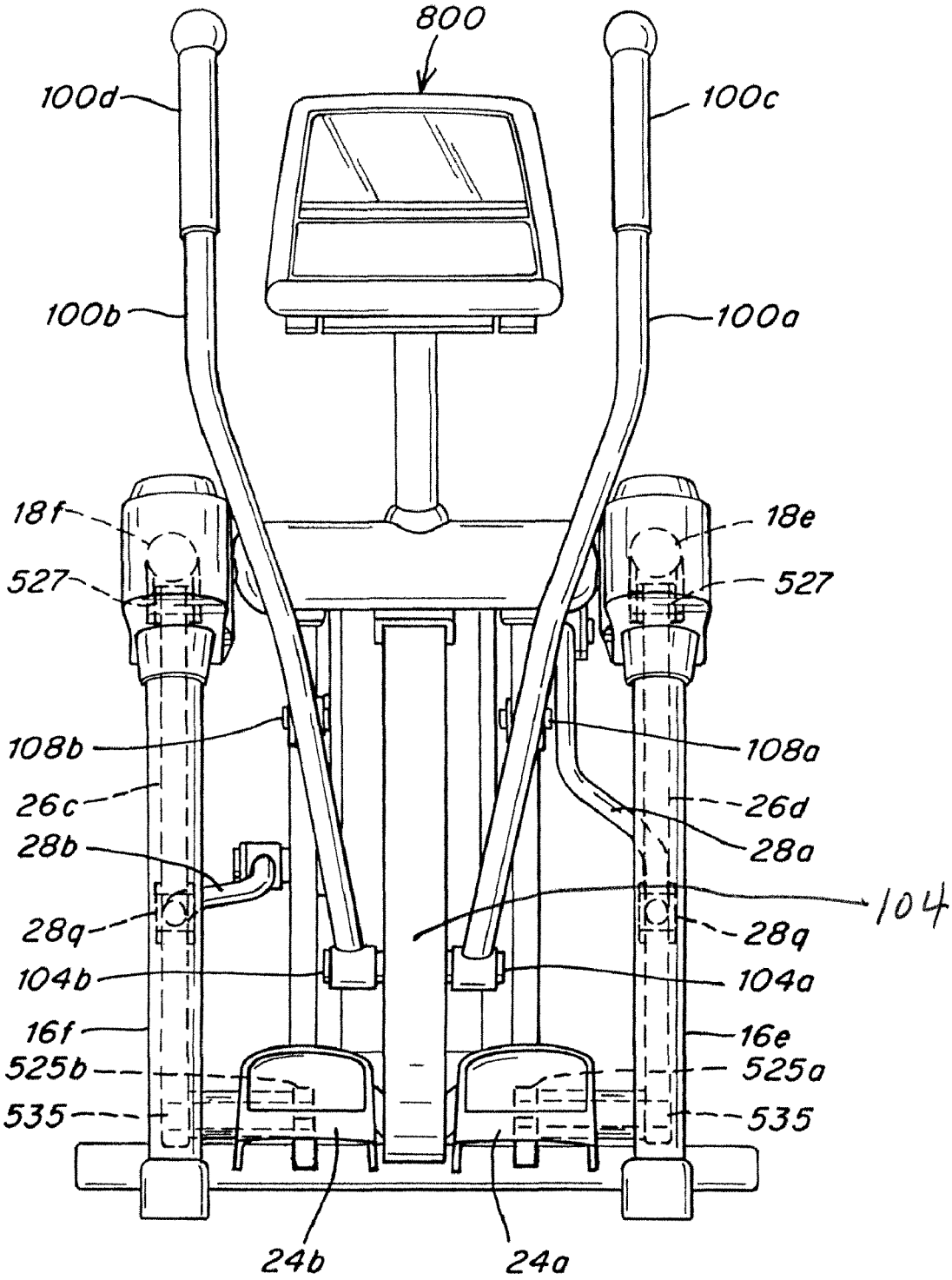
FIG. 2 is a rear view of the machine of FIG. 1.
Figure 3:
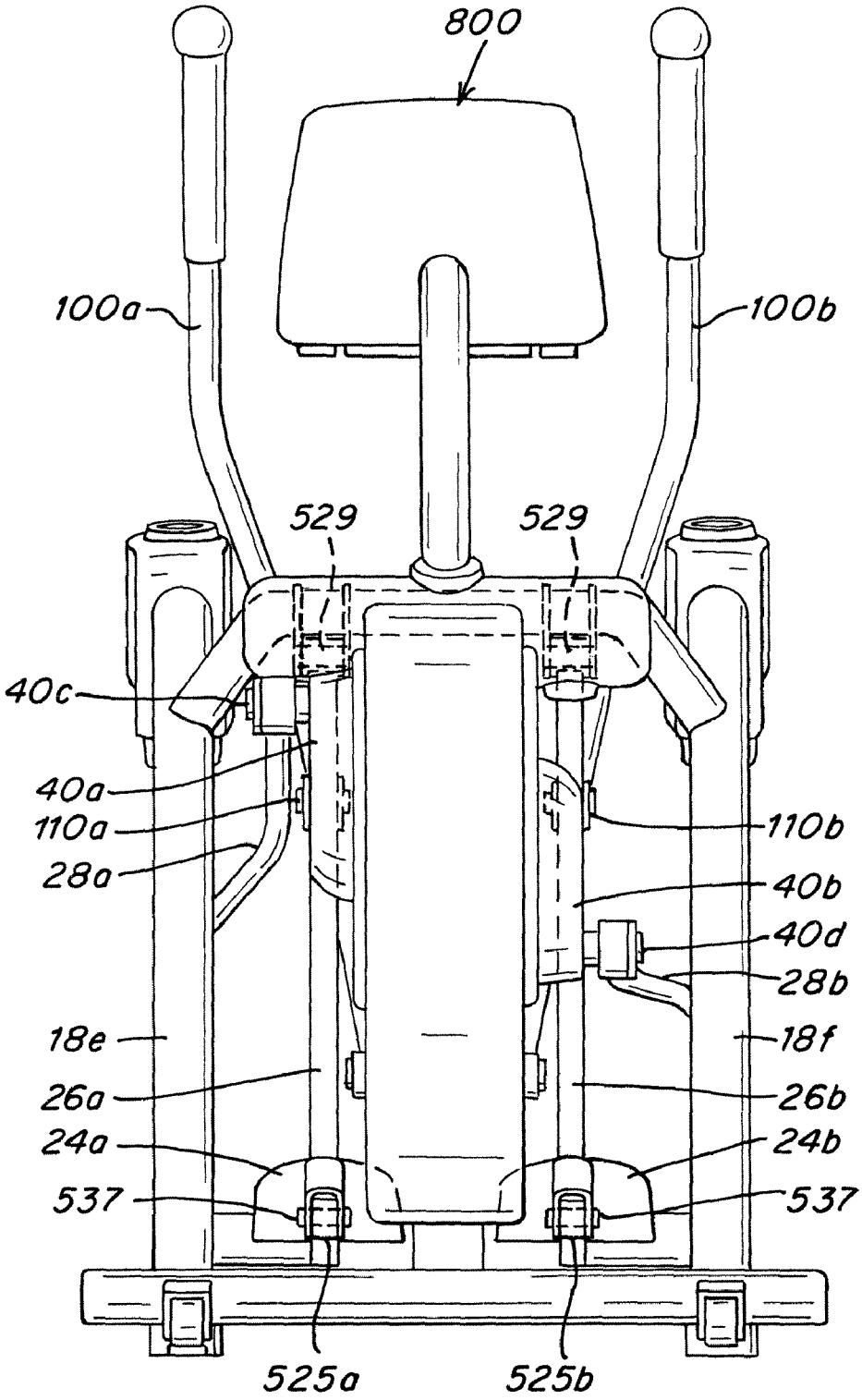
FIG. 3 is a front view of the machine of FIG. 1.
Figure 4:
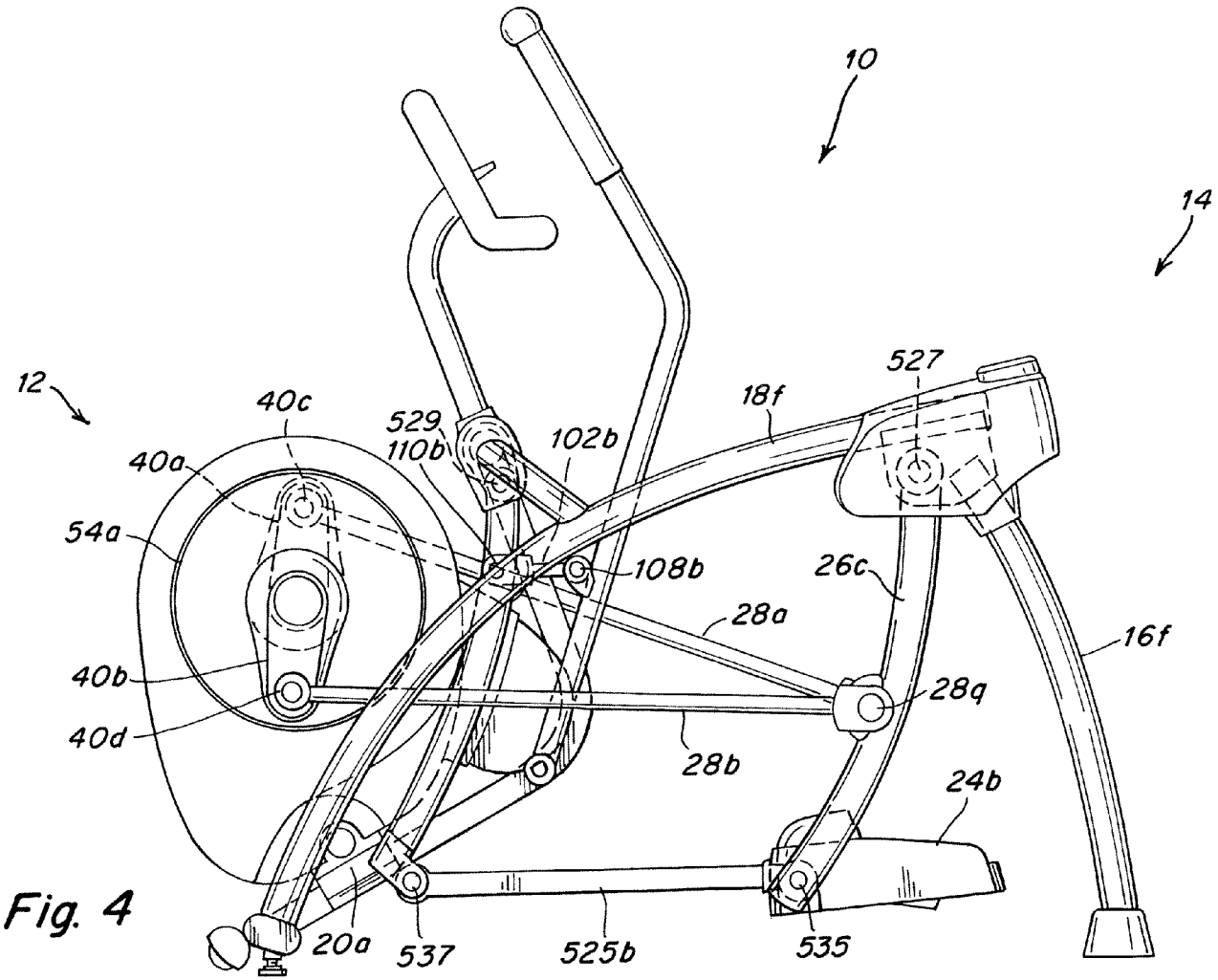
FIG. 4 is a left side view of the machine of FIG. 1.
Figure 5:
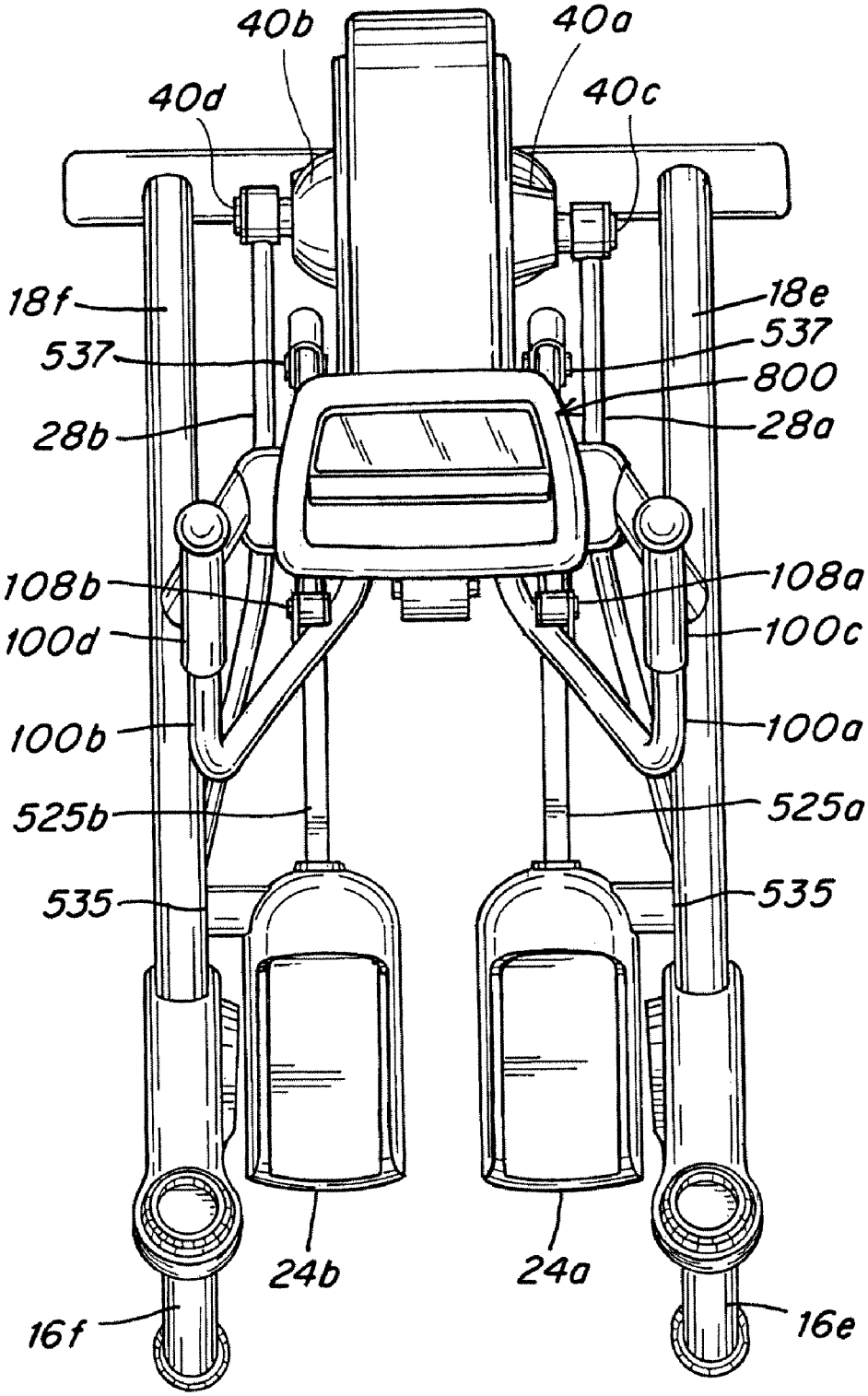
FIG. 5 is a top plan view of the device of FIG. 1.

There is shown in FIG. 1 an exercise device or machine 10 in accordance with the invention. The machine includes a frame 20 having a front region 12, a rear region 14, legs 16*e*, 16*f* and upper supports 18*e*, 18*f*. Upper frame supports 18*e* and 18*f* comprise the upper links of a pair of four bar linkages. The upper supports are rigidly connected to legs 16*e* and 16*f* respectively and collectively comprise an integral part of frame 20. A display/control panel 800 is rigidly connected to the frame 20 and disposed at the forward 12 end of the machine 10. A pair of right and left force/energy input arms 100*a*, 100*b* with upper end hand grips 100*c*, 100*d* are pivotally mounted on the frame at pivot points 104*a*, 104*b* for back and forth movement from front to back and back to front. The input arms 100*a*, 100*b* are pivotally interconnected to drive linkages 102*a*, 102*b* at pivot points 108*a*, 108*b*, the drive linkages in turn being pivotally connected to front frame assembly linkages 26*a*, 26*b* at pivot points 110*a*, 110*b*.

Foot supports 24*a* and 24*b* are sized to receive the foot of a user and are suspended on the frame 20 by a frame linkage assembly for front to back, back to front reciprocal movement under the force of a user's exerting a backwardly or forwardly directed force FO on the foot supports using the user's leg and hip muscles. The frame linkage assembly comprises forward linkages or legs 26*a* and 26*b*, and rear linkages 26*c* and 26*d*. Linkages 26*a*-26*d* are movably/pivotally connected to the upper support arms 18*e*, 18*f* of frame 20 at pivot points 527, 529. The foot supports 24*a* and 24*b* are mounted on lower linkages 525*a*, 525*b* which are in turn movably/pivotally connected to the frame assembly linkages 26*a*-26*d* at pivot points 531, 533, 535, 537. Collectively, the linkages 26*a-d*, 525*a-b* and 18*e-f* comprise a four bar linkage. Although the device is shown as a four bar linkage with opposing pairs of linkages supporting each foot support, other embodiments are contemplated having fewer or more linkages supporting and controlling the range and path of motion of foot supports 24*a* and 24*b* associated with the linkage(s).

The foot supports 24*a* and 24*b* approximate a shoed human foot in size and shape. They can include a non-skid surface and be bounded by one or more low lips to help a shoe remain in place on the foot supports during use. Alternately, straps may maintain each foot within the foot support to further retain the user's foot in place during use. However, as used herein, a "foot support" can also encompass any designated support such as a pedal, a pad, a toe clip, or other foot/toe/leg and device interface structure as is known in the art. As shown, the sole receiving surface of the foot supports faces vertically upward and the supports 24*a*, 24*b* are mounted on the top surfaces of lower linkages 525*a*, 525*b* such that a user must stand on the foot supports in a generally vertically upright disposition and can forcibly move the foot supports together with the frame linkages in a generally horizontal front to rear and rear to front direction by pushing forwardly or pulling backwardly on the foot pedals by use of the user's leg and hip and associated muscles.

The rearward linkages or legs 26*c* and 26*d* of the linkage assembly are pivotally connected to a drive linkage 28*a*, 28*b* via a pivot mechanism 28*q*. The right and left drive linkages 28*a*, 28*b* are directly pivotally connected at a distal end to right and left crank arms 40*a*, 40*b* which are arranged 180 degrees out of phase relative to each other and connected to the axle/shaft 32 of flywheel or resistance mechanism 54*a*. The crank arms 40*a*, 40*b* are rotatable 360 degrees.

Figure 6:
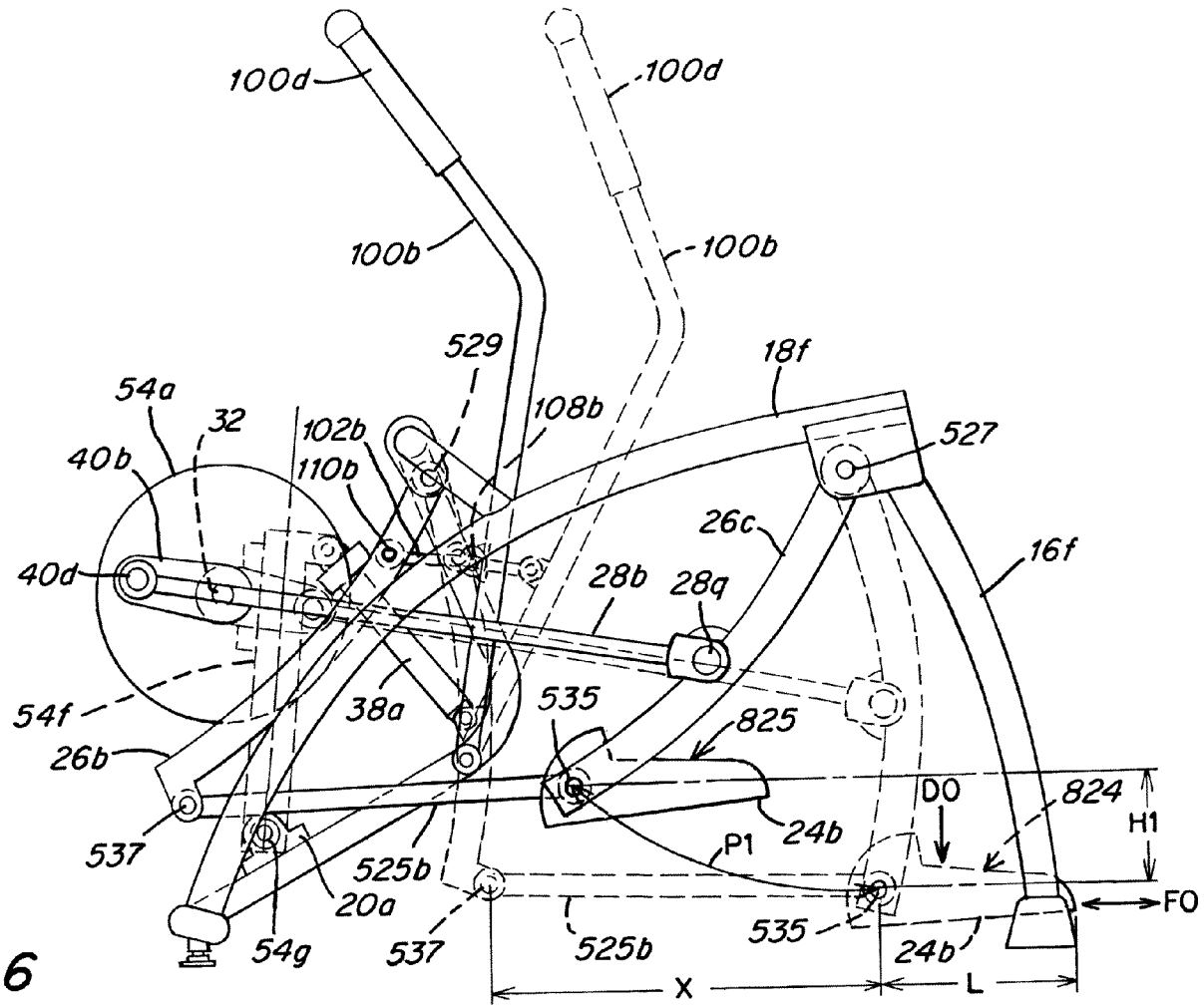
FIG. 6 is a left side schematic view of the machine of FIG. 1 showing the resistance mechanism in a first less tilted position such that the foot support travels in an arc segment path of lesser incline.
Figure 7:
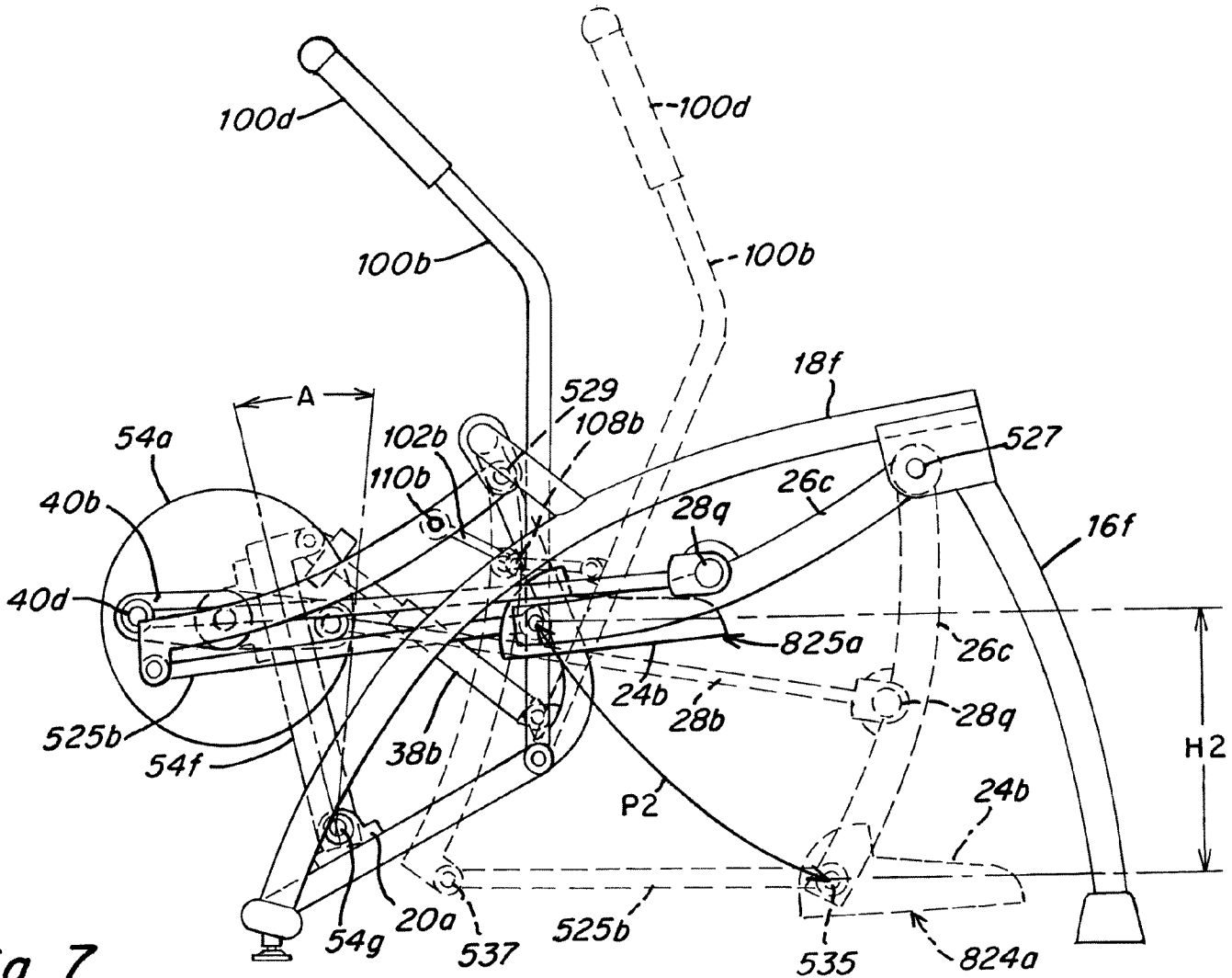
FIG. 7 is a left side schematic view of the FIG. 1 machine showing the resistance mechanism in a second more tilted position such that the foot support travels in an arc segment path of greater incline.

As shown in FIGS. 6, 7 the foot supports 24*a*, 24*b* and associated frame linkages, 26*a-d*, move along discrete reproducible selected segments P1, P2 of an overall arcuate path defined by the arrangement and configuration of the frame 20, the linkages, the foot supports and associated machine components. As shown, the foot supports travel between rearwardmost/downwardmost 824, 824*a* (shown in dashed lines) and forwardmost/upwardmost 825, 825*a*, (shown in solid lines) positions during the course of an exercise cycle along the selected arc segments P1, P2.

FIG. 6 shows the apparatus with the flywheel resistance assembly 54 in a user selectable/selected downwardmost position, the driven tilt mechanism 38*a* being shown in its most retracted position as preselected by the user's operation of the user operation interface 800. The tilt mechanism 38*a, b*, as shown is pivotally connected to the flywheel/resistance assembly 54*a* and has a driven shaft that is controllably extendable to pivot the resistance assembly 54*a* between retracted 38*a* and extended 38*b* positions, FIGS. 6, 7 and to any selected extended position in between the positions shown in FIGS. 6, 7. The flywheel/resistance assembly 54*a* is mounted on arms 54*f* that are in turn pivotally mounted at a pivot point 54*g* on a frame member 20*a*. The user can controllably select the degree of extension of the tilt mechanism 38*a-b* by operation of a motor or other conventional electrically controllable mechanism (not shown) that is connected to and controls the operation of the tilt mechanism 38*a, b*. The degree of incline of the arcuate path of travel of the foot supports such as P1, P2 can thus be controllably varied by virtue of the interconnection of the crank arms 40*a*, 40*b* of the resistance assembly 54*a* to the frame linkage assembly arms 26*c*, 26*d* and to the frame linkage assembly generally. In the position of tilt as shown in FIG. 6 the foot supports and associated linkages travel along a less steep, less inclined arc segment P1 having a smaller vertical height of travel, H1, relative to the arc segment P2 shown in FIG. 7 where the tilt mechanism 38*b* is extended to cause the assembly arm 54*g* to be tilted forwardly an angle A relative to the position of the arm 54*g* shown in FIG. 6, the resulting arc segment path of travel of the foot supports P2 having a steeper incline with a longer vertical height of travel H2 shown in FIGS. 6, 7. As can be readily imagined, any arcuate path of lesser or greater incline between P1 and P2 can be selected by controllable selection of the degree of extension of tilt mechanism 38*a, b* and the degree of angle A thus selected.

As shown in FIGS. 6, 7 the foot supports travel between a downwardmost and rearwardmost position 824, 824*a* (dashed lined) and a forwardmost and upwardmost 825, 825*a*, (solid lined) position. As rear linkages 26*c*, 26*d* travel from back to front and front to back, the crank arms 40*a*, 40*b* to which the linkages 26*c*, 26*d* are pivotally interconnected via shaft drive linkages 28*a*, 28*b* are reciprocally rotated 360 degrees thus rotating the flywheel 54*a*. Thus a complete forward to back, back to forward movement of the frame assembly and foot supports 24*a*, 24*b* along a selected arcuate path such as P1 or P2 effects a complete 360 degree rotation of the shaft 32 of the flywheel 54*a* via the pivotal interconnections of the drive linkages 28*a*, 28*b* between the rear frame assembly linkages 26*c* and 26*d* and the crank arms 40*a*, 40*b*.

Monitor 20 may include displays and controls to allow the user to manipulate the intensity of the resistance to create an easier or more difficult exercise routine and to adjust the motion path of the foot supports to one that is more inclined or less inclined.

Although the brake/flywheel assembly 54*a* is one embodiment, various other braking devices such as known to those skilled in the art can be interconnected to the drive linkages 28*a*, 28*b* to inhibit back and forth movement thereof. The braking device may include but is not limited to any of the following: friction and air resistance devices such as fans, pneumatic or hydraulic devices, as well as various other types of electromechanical braking devices. This list is by no means exhaustive and represents only a few examples of resistance mechanisms that may be incorporated into the present invention. The configuration disclosed herein, i.e. use of a flywheel assembly 54*a* with crank arms 40*a*, 40*b* is one embodiment.

In operation, a user approaches the device from the rear region 14, grasps the hand grips 100*c*, 100*d*, and places a foot on each of the foot supports 24*a* and 24*b*. The user's feet and legs begin to move fore and aft in a comfortable stride. The user selects an exercise program or manually adjusts the device by inputting commands via the display/control panel 20. In response to the command input, the resistance to fore and aft movement of the foot supports 24*a* and 24*b* can be altered by impeding rotation of the flywheel. Also, in response to command input, the mounting 38*a*, 38*b* is moved or tilted fore or aft. As shown, when the mounting 38*a, b* moves forward, the motion path of the foot supports is on a more inclined or vertical defined arc segment. To discontinue use of the device, a user simply stops striding, thereby causing the movement of the device to stop, and dismounts from the foot supports.

The foot supports and the frame linkages are typically mounted/arranged on the frame such that the degree of rotation or pivot of the foot pedals 24*a*, 24*b* from back to front and front to back along the arcuate path of translation of the foot pedal from front to back and vice versa is less than about 3 degrees, typically less than about 2.5 degrees. The foot pedals have a foot sole receiving upper surface that defines a generally planar orientation or plane in which the sole of the foot of the user is maintained when standing on a foot pedal.

A pair of pivoting upper body input arms 100*a*, 100*b* are provided that the user can manually grasp by hand at an upper region such as handles 100*c*, 100*d*, the handles being a rigidly connected extension of arms 100*a*, 100*b* respectively and moving/pivoting together with the arms forward or backward. The handles 100*c*, 100*d* and arms 100*a*, 100*b* are pivotably interconnected to the frame and to the pedals. As shown the arms 100*a*, 100*b* are pivotably interconnected to the frame 20 via a pivot mount member 104 that is connected to the frame 20, the bottom ends of the arms 100*a*, 100*b* being freely pivotably mounted via pin/aperture joints 104*a*, 104*b* at their bottom ends. Arm linkage members 102*a*, 102*b*, are pivotably attached at one end to the arms at joints 108*a*, 108*b* which allow the linkage members to rotate/pivot on and with respect to the arms and pivotably attached at another end to the forward longitudinal four bar linkage members 26*a*, 26*b* respectively via joints 110*a*, 110*b* that allow the linkage members 26*a*, 26*b* to rotate around the axes of the joints.

As shown in FIGS. 6, 7 as the foot supports 24*a*, 24*b* and frame linkage assembly travels from either front to back or from back to front, the handles 100*c, d* and arms 100*a, b* follow the front to back movement of the pedals 24*a*, 24*b* with a pivoting front to back or back to front movement. That is, when the right pedal 24*a* moves forwardly the right handle 100*c* and arm 100*a* pivot or move forwardly; when the right pedal 24*a* moves backwardly the right handle 100*c* and arm 100*a* pivot or move rearwardly, FIGS. 6, 7; similarly when the left pedal 24*b* moves forwardly the handle 100*d* and arm 100*b* pivot or move forwardly; when the left pedal 24*b* moves rearwardly the handle 100*d* and arm 100*b* pivot or move rearwardly. As shown the frame linkage assembly generally moves forwardly and backwardly together with forward and backward movement of the input handles and arms. The degree of front to back pivoting of the arms 100*a, b* can be predetermined at least by selective positioning of the pivot joints 108*a*, 108*b*, 110*a*, 110*b*, selective positioning of the mount 104 and selection of the lengths of linkage arms 102*a*, 102*b*.

In the embodiments shown, the user can reduce or transfer the amount of energy or power required by the user's legs and/or feet to cause the foot pedals to travel along the arcuate path P1, P2 from back to front by pushing forwardly on the upper end of the arms 100*a*, 100*b* during the back to front pedal movement. And, the user can increase the speed of forward movement by such pushing; or reduce the speed and increase the power or energy required by the legs to effect forward movement by pulling. Conversely the user can reduce or transfer the amount of power or energy required to cause the pedals to move from front to back by pulling backwardly on the upper end of the arms. And, the user can increase the speed of rearward movement by such pulling or reduce the speed by pushing; or reduce the speed and increase the power or energy required by the legs to effect rearward movement by pushing.

The linkage and foot support assemblies, 24*a-b*, 26*a-d*, 18*e-f* that are pivotably linked via the linkages 102*a*, 102*b* to the pivotably mounted arms 100*a, b* can be configured to enable the foot pedal and the plane in which the sole of the foot is mounted to either not rotate or to rotate/pivot to any desired degree during front to back movement by preselecting the lengths of each and any of the links 26*a-d*, 18*e-f* appropriately to cause the desired degree of rotation/pivoting.

In the embodiments shown, the drive linkages 28*a* and 28*b* are interconnected to the flywheel 54*a* at opposing 180 degree circle positions 40*c*, 40*d* from the center of rotation of the shaft 32 and crank arms 40*a, b* of flywheel 54*a*, i.e. the linkages are connected at maximum forward and maximum rearward drive positions respectively. This 180 degree opposing interconnection causes the right 24*a* and left 24*b* foot pedals to always travel in opposite back and forth translational directions, i.e. when the right pedal is traveling forward the left pedal is traveling backwards and vice versa. Similarly, the pivotably mounted arms 100*a* and 100*b* are interconnected to the flywheel 54*a* such that when the right arm is moving forward the left arm is moving backward and vice versa. As shown in FIGS. 1, 4, 6, 7 the arms 100*a*, 100*b* travel forwardly or backwardly together with their associated foot supports 24*a* and 24*b* respectively.

In any event, the right side and left side pedals 24*a, b* and input arms 100*a, b* are linked to the resistance or drive assembly (in the embodiments shown, the flywheel and associated crank arms) such that when the left side components (i.e. left pedal and associated input arm) are traveling forward the right side components (i.e. right pedal associated input arm) are traveling backward for at least the majority of the travel path and vice versa.

In the same manner as forward or backward pivoting of the mounting member 38 changes the degree of incline, height and/or path of travel of foot pedals 24*a, b* as described above, a forward or backward pivoting of the mounting member 38 also changes the degree of back to front pivoting and/or the degree of path of travel of arms 100*a, b*. Thus, in the same manner as the user is able to select the degree of incline of the path of travel of the foot pedals, e.g. arc path P1, P2, the user is able to select the degree, length, path of travel of back to front, front to back pivot stroke or travel path of input arms, 100*a, b*, by adjusting the front to back pivot position of the linkage 102*a, b*.

As shown, the vertically disposed links 26*a-d* of the four bar linkage are pivotally connected and supported at upper pivot points, e.g. points 527, 529 on the frame members 18*e-f* and pivotally connected to the lower linkages 525*a-b* at lower pivot points, e.g. points 535, 537.

As shown in FIG. 6, the longitudinal lengths L of the footplates 24*a*, 24*b* extend beyond and rearwardly of the lower inside lengths X of the lower four bar linkages 525*a*, 525*b* and thus beyond, i.e. rearwardly of the pivot points 535 at which the lower linkages 525*a-b*, are pivotally connected to the rear linkages 26*c-d*. By such an arrangement, the footplates 24*a* and 24*b* are cantilevered in their structure, function and movement relative to the four bar linkage assembly around lower pivot points 535. The load DO exerted on foot supports 24*a-b* by a user as shown is supported primarily by rear linkages 26*c, d* at the pivot connections 535.

The degree of leverage or cantileverage force exertable by exertion of a downward force DO on the foot supports 24*a* and 24*b* around the pivot points 535 can be varied by variably selecting the overall distance by which the footplates 24*a*, 24*b* extend beyond or rearwardly of the lower pivot points 535 of the four bar linkage assembly. As shown in FIG. 6, the rear end of the footplates 24*a*, 24*b* are distanced away from the pivot points 535 by distance L. As shown the front terminal ends of the footplates 24*a* and 24*b* are connected to the rear terminal ends of lower bar or linkages 525*a*, 525*b*, the maximum cantilever distance in the FIG. 6 embodiment being essentially the length L of the foot supports 24*a*, 24*b*. As can be readily imagined, the leverage/cantileverage force can be selectively varied by varying the distance by which the foot supports extend rearwardly of the pivot points 535.

Thus, by mounting or connecting the footplates 24*a* and 24*b* to the lower bar/linkage such that some portion or all of the length of the footplates extend rearwardly or beyond the position of the lower rear pivot points 535 of the four bar linkage, the user is provided with the ability to exert a lever or cantilever force when pushing downwardly DO or forwardly FO, FIG. 6 with the user's legs and/or feet on the top surface of the footplates 24*a* and 24*b*. The degree of such leverage can be selected by preselecting the length L or the distance of mounting of the foot support from the pivot points 535. The longer the cantilever distance, the greater the cantilever or lever force that is exertable with the same amount of DO force.

The precise artistic or identifying shape, contour and visual appearance of the structural and functional components of the apparati depicted in all of the Figures in this application is a matter of visual or source identifying design choice, it being understood that many of said structural components can also serve the mechanical functions as described herein.

The invention claimed is:

1. An exercise device comprising:

a frame supporting a frame linkage assembly;

left and right foot supports suspended on the frame linkage assembly in a cantilevered arrangement for pivoting movement of the foot supports and the frame linkage assembly along a back and forth arcuate path;

the frame linkage assembly having a rear foot support linkage that is pivotally interconnected to a rotatable arm that is drivably rotated by the back and forth movement of the foot supports and frame linkage assembly, the movement of the foot supports on the arcuate path from a rearwardmost and downwardmost position to a forwardmost and upwardmost position back to the rearwardmost and downwardmost position defining a complete cycle; and, an incline selector interconnected to the cantilevered foot supports, the incline selector being adjustable to effectively select one or more segments of the arcuate path upon which the foot supports will travel, each segment having a different rearwardmost and downwardmost position, and forwardmost and upwardmost position and thus a different degree of incline such that a complete cycle of the foot supports on the arcuate path can be effectively changed.

2. The exercise device of claim 1 wherein the foot supports are supported in a cantilevered arrangement on the frame linkage assembly rearward of the rear foot support linkage.

3. The exercise device of claim 1 further comprising a pair of left and right manually graspable input arms pivotably interconnected to a respective one of the left and right foot supports such that the left arm pivots forwardly together with forward movement of the left foot support and rearwardly together with backward movement of the left foot support and such that the right arm pivots forwardly together with forward movement of the right foot support and backwardly together with backward movement of the right foot support.

4. The exercise device of claim 1 wherein the foot supports are mounted for movement back and forth between a rearward down position and a forward up position.

5. The exercise device of claim 1 wherein the frame linkage comprises an arrangement of left and right front, bottom and rear linkages pivotally interconnected to each other, the foot supports being mounted on the bottom linkages rearward of the rear linkage.

6. The exercise device of claim 1 wherein the frame linkage is selectively adjustable to limit the back and forth travel of the frame linkage to any one of a plurality of separate reproducible segments of the arcuate path.

7. The exercise device of claim 2 wherein the frame linkage is selectively adjustable to limit the back and forth travel of the frame linkage to any one of a plurality of separate reproducible segments of the arcuate path.

8. The exercise device of claim 5 wherein the frame linkage is selectively adjustable to limit the back and forth travel of the frame linkage to any one of a plurality of separate reproducible segments of the arcuate path.

* * * * *